US011376754B2

(12) United States Patent
Brenner et al.

(10) Patent No.: US 11,376,754 B2
(45) Date of Patent: Jul. 5, 2022

(54) ROTARY SHAVING APPARATUS WITHOUT DIRECT FORCEABLE CONTACT BETWEEN THE BLADES AND THE SKIN

(71) Applicant: HYBRID RAZOR LTD., Caesarea (IL)

(72) Inventors: Shai Brenner, Haifa (IL); Shoam Zak, Givat Ela (IL)

(73) Assignee: HYBRID RAZOR LTD., Caesarea (IL)

( * ) Notice: Subject to any disclaimer, the term of this patent is extended or adjusted under 35 U.S.C. 154(b) by 0 days.

(21) Appl. No.: 17/263,825

(22) PCT Filed: Aug. 1, 2019

(86) PCT No.: PCT/IL2019/050870
§ 371 (c)(1),
(2) Date: Jan. 27, 2021

(87) PCT Pub. No.: WO2020/026248
PCT Pub. Date: Feb. 6, 2020

(65) Prior Publication Data

US 2021/0291391 A1 Sep. 23, 2021

Related U.S. Application Data

(60) Provisional application No. 62/713,610, filed on Aug. 2, 2018.

(51) Int. Cl.
*B26B 19/18* (2006.01)
*B26B 21/34* (2006.01)
(Continued)

(52) U.S. Cl.
CPC ..... *B26B 19/18* (2013.01); *B26B 19/20* (2013.01); *B26B 21/34* (2013.01); *B26B 21/42* (2013.01)

(58) Field of Classification Search
CPC ..... B26B 19/18; B26B 19/20; B26B 21/34; B26B 21/42
See application file for complete search history.

(56) References Cited

U.S. PATENT DOCUMENTS 2,870,534 A * 1/1959 Angst ..... B65D 43/0233 30/346.51
5,933,960 A * 8/1999 Avidor ..... B26B 21/34 30/34.2
(Continued)

FOREIGN PATENT DOCUMENTS

CH 355713 A 7/1961
DE 19514228 A1 10/1996
(Continued)

OTHER PUBLICATIONS

PCT Search Report for International Application No. PCT/IL2019/050870; dated Nov. 17, 2019 ; 7 pp.
(Continued)

*Primary Examiner* — Stephen Choi
(74) *Attorney, Agent, or Firm* — The Roy Gross Law Firm, LLC; Roy Gross

(57) ABSTRACT

There is provided a shaving apparatus having a head shaving portion that includes a rotary cutter and one or more roller elements configured to provide close skin contact with a fixed cutting blade, as well as to methods of using the same for efficient cutting of hair bristles off a skin region.

20 Claims, 6 Drawing Sheets

(51) Int. Cl.
*B26B 21/42* (2006.01)
*B26B 19/20* (2006.01)

(56) References Cited

U.S. PATENT DOCUMENTS

| | | | | |
|---|---|---|---|---|
| 8,876,809 | B2 * | 11/2014 | Eckhouse | A45D 26/0023 607/101 |
| 10,695,924 | B2 * | 6/2020 | Zak | B26B 19/18 |
| 2002/0157255 | A1 * | 10/2002 | Coffin | B26B 21/44 30/538 |
| 2015/0183118 | A1 | 7/2015 | Roth | |
| 2017/0057103 | A1 * | 3/2017 | Perlberg | B26B 21/34 |
| 2018/0111280 | A1 * | 4/2018 | Marut | B26B 21/4018 |

FOREIGN PATENT DOCUMENTS

| | | | |
|---|---|---|---|
| DE | 69924468 | T2 | 2/2006 |
| JP | 3703137 | B2 | 10/2005 |
| JP | 2014023545 | A | 2/2014 |
| JP | 5522715 | | 6/2014 |
| KR | 20110123660 | A | 11/2011 |
| KR | 20160130397 | A | 11/2016 |
| WO | 2014166350 | A1 | 10/2014 |

OTHER PUBLICATIONS

PCT Written Opinion for International Application No. PCT/IL2019/050870; dated Nov. 17, 2019; 5 pp.
PCT Preliminary Report for International Application No. PCT/IL2019/050870; dated Feb. 2, 2021; 6 pp.

* cited by examiner

ROTARY SHAVING APPARATUS WITHOUT DIRECT FORCEABLE CONTACT BETWEEN THE BLADES AND THE SKIN

CROSS REFERENCE TO RELATED APPLICATIONS

This application is a National Phase of PCT Patent Application No. PCT/IL2019/050870 having International filing date of Aug. 1, 2019, which claims the benefit of priority of U.S. Provisional Patent Application No. 62/713,610, filed Aug. 2, 2018, the contents of which are all incorporated herein by reference in their entirety.

FIELD OF THE INVENTION

The present invention generally relates to a shaving apparatus having a shaving head portion which includes roller elements, as well as to methods of using the same for removal of hair from a skin region.

BACKGROUND OF THE INVENTION

Methods for removing hair from skin surface, by shaving (i.e., cutting of the hair rather than pulling the hair (such as in epilation), involve the razor blade approach, where a very sharp blade is pushed against the skin at an angle, thereby cutting hair; and the screen approach, wherein a thin fenestrated metal screen is moved across the skin, exposing hair though the holes and cutting them by a mechanized, typically motorized, cutting element.

In the razor blade approach, the energy for cutting is provided by driving the razor across the skin of the user, for example, by the hand of the user, and the hair is cut by the impact force applied thereon and by virtue of its stiffness. One of the downsides of such approach is the risk of nicks and cuts due to the sharpness and angle of the blade as it is driven forcefully across the skin.

Furthermore, existing electric razors which require a user to force hair through a static screen, requires the user to press the device reasonably hard against the skin. This action can cause irritations to the skin including pressing the hair back against the skin which results in ingrown hairs. In shearing-type shaving apparatuses, there is difficulty in ensuring that all hairs are cut and in preventing the cut hairs from growing back into the skin.

A cutting technique which could require minimal force for cutting hair can be affected by scissors. Scissors cut hair at the crossing point of two blades which do not have to be very sharp in order to cut the hair due to the fact that the blades contact the hair from substantially opposite directions in the plane of cutting, mutually providing each other with a counter-force for cutting. However, it is impractical to use scissors for daily shaving, which requires maximal closeness of the cutting point to the skin.

Thus, there is a need in the art for improved shaving apparatus that allows an efficient, safe and close shaving and removal of hair for skin surface, without inducing irritation of the skin or inducing undesired ingrown hair from growing back into the skin.

SUMMARY OF THE INVENTION

According to some embodiments, there is provided an advantageous shaving apparatus having a handle portion and a head portion, wherein the head portion includes a rotary cutter element, a fixed blade cutter located in close proximity thereto, and one or more rollers, configured to allow or maintain a desired distance/space between the rotary cutter element and/or the blade and the skin surface, so as to allow an efficient cutting of hair bristles, preferably without the rotary cutter and/or the fixed blade touching the skin. This allows for a very efficient cutting of the hair from the skin surface, without inducing irritation of the skin and without harming the skin surface by the action of the rotary cutters and/or the cutting blade. Thus, the disclosed having apparatus, and in particular, the advantageous head portion thereof allows for a very efficient hair cutting without irritating a sensitive skin.

In some embodiments, the advantageous shaving apparatus utilizes the shearing technique to cut hair bristles between the rotary cutter and the fixed blade, while maintaining or controlling a desired space/distance between these cutters and the skin, wherein the distance is determined/controlled by the one or more roller elements.

According to some embodiments, there is provided a shaving apparatus which includes: a handle portion and a head portion, the head portion includes: a rotary cutting element comprising a cylindrical screen having a plurality of cutting edge openings on the outer surface thereof, the screen being rotatable about a rotational axis; one or more fixed blades located in close proximity to the outer surface of the rotary cutting element; and at one or more roller elements configured to be in contact with a skin surface of a subject and to further control or maintain a distance between the rotary cutting element and/or the fixed blade and the skin of the subject, such that the rotary cutting element and/or the fixed blades are capable of cutting hair bristles from the skin, while maintaining essentially minimal contact with the skin surface.

According to some embodiments, there is provided a head portion of a shaving apparatus, wherein the head portion includes a rotary cutting element comprising a cylindrical screen having a plurality of cutting edge openings on the outer surface thereof, the screen being rotatable about a rotational axis; one or more fixed blades located in close proximity to the outer surface of the rotary cutting element; and one or more roller elements configured to be in contact with a skin surface of a subject and to further control or maintain a distance between the rotary cutting element and/or the fixed blade and the skin of the subject, such that the rotary cutting element and/or the fixed blades are capable of cutting hair bristles from the skin, while maintaining essentially minimal contact with the skin surface.

According to some embodiments, there is provided a method of shaving, the method includes holding the shaving apparatus disclosed herein on the skin surface, such that a distance between the rotary cutting element and/or the fixed blade is determined/maintained by the rollers, such that the cutting elements re capable of cutting hair bristles from the skin, while maintaining essentially minimal contact with the skin surface, to thereby allow an efficient shave, without irritating the skin.

According to some embodiments, there is provided a shaving apparatus which includes a handle portion and a head portion, the head portion includes: a rotary cutting element which includes a cylindrical screen having a plurality of cutting edge openings on the outer surface thereof, the screen being rotatable about a rotational axis; one or more fixed blades located in close proximity to the outer surface of the rotary cutting element; and one or more roller elements configured to be in contact with a skin surface of a subject and to further control or maintain a distance between the rotary cutting element and/or the fixed blade and the skin of the subject, such that the rotary cutting element and/or the fixed blades are capable of cutting hair bristles from the skin, while maintaining essentially minimal contact with the skin surface.

According to some embodiments, the head portion includes at least two rollers. In some embodiments, the rollers are substantially tubular or cylindrical.

In some embodiments, one or more of the rollers may include an outer surface with ridges protruding therefrom.

In some embodiments, the one or more rollers may be placed in a direction that is parallel to the elongated rotational axis of the rotary cutting element.

In some embodiments, a first roller and a second roller may be located on opposite sides of the rotational axis of the rotary cutting element.

In some embodiments, the one or more fixed blades may be flexible.

In some embodiments, the one or more rollers may have a similar diameter.

In some embodiments, the one or more rollers may have a different diameter.

In some embodiments, the one or more rollers may be fixed or movable along a horizontal axis.

In some embodiments, the vertical distance between the rotary cutting element and/or the fixed blade and the rollers may be in the range of about 0.5 mm to 3 mm. In some embodiments, the distance between the outer surface of the rotary cutting element and/or the fixed blade and the and the common plain in which the apexes of the rollers lay in is in the range of about 0.5 mm to 3 mm.

In some embodiments, the vertical distance between the lower end of the rotary cutting element and/or the fixed blade and the lower end of the one or more rollers is in the range of about 0.5 mm to 3 mm.

In some embodiments, the diameter of the one or more rollers may be in the range of about 4 mm to about 10 mm.

In some embodiments, the rollers may include a cavity and are further configured to dispense a substance.

In some embodiments, the substance may include a cream, lotion, gel, ointment, or combinations thereof.

In some embodiments, the rotary cutting element and the fixed blade allow cutting of the hair by the action of flying scissors.

In some embodiments, the cutting edge openings may include holes having various geometrical shapes.

In some embodiments, the shaving apparatus may further include a motor and a power source.

In some embodiments, the shaving apparatus may be configured to allow close shaving of the skin of the subject without generating heat at the skin surface and/or without applying pressure on the skin.

In some embodiments, the head portion may be configured to be reversibly mounted on the handle portion. In some embodiments, the head portion is disposable. In some embodiments, any one of: the rotary cutting element, one or more blades and/or one or more roller elements may be disposable. Each possibility is a separate embodiment.

According to some embodiments, there is provided a head portion of a shaving apparatus, the head portion includes:—a rotary cutting element which includes a cylindrical screen having a plurality of cutting edge openings on the outer surface thereof, the screen being rotatable about a rotational axis; one or more fixed blades located in close proximity to the outer surface of the rotary cutting element; and one or more roller elements configured to be in contact with a skin surface of a subject and to further control or maintain a distance between the rotary cutting element and/or the fixed blade and the skin of the subject, such that the rotary cutting element and/or the fixed blades are capable of cutting hair bristles from the skin, while maintaining essentially minimal contact with the skin surface.

In some embodiments, the head portion may be configured to be attached or mounted to a hand portion of a shaving apparatus.

In some embodiments, the one or more flexible blades and the one or more roller elements of the head portion may be mounted on a replaceable cartridge that is detachably coupled to the head portion.

In some embodiments, the head portion includes at least two rollers.

In some embodiments, one or more of the rollers of the head portion may include an outer surface with ridges protruding therefrom.

In some embodiments, the one or more rollers may be placed in a direction that is parallel to the elongated rotational axis of the rotary cutting element.

In some embodiments, a first roller and a second roller of the head portion may be located on opposite sides of the rotational axis of the rotary cutting element.

According to some embodiments, the one or more fixed blades of the head portion may be flexible.

In some embodiments, when having more than one roller element, the one or more roller elements of the head portion may have a similar diameter. In some embodiments, the one or more roller elements of the head portion may have a different diameter.

In some embodiments, the one or more roller elements of the head portion may be fixed or movable along a horizontal axis.

In some embodiments, the one or more roller elements of the head portion may include a cavity and are may further be configured to dispense a substance. In some embodiments, the substance may include a cream, lotion, gel, ointment, or combinations thereof.

According to some embodiments, there is provided a method of shaving a skin surface, the method comprising: pressing a head portion of a shaving apparatus, said head portion includes: a rotary cutting element comprising a cylindrical screen having a plurality of cutting edge openings on the outer surface thereof, the screen being rotatable about a rotational axis; one or more fixed blades located in close proximity to the outer surface of the rotary cutting element; and one or more roller elements; such that the rollers elements are configured to be in contact with the skin surface of the subject and allow controlling or maintaining a distance between the rotary cutting element and/or the fixed blade and the skin of the subject, such that the rotary cutting element and/or the fixed blades are capable of cutting hair bristles from the skin, while maintaining essentially minimal contact with the skin surface.

Certain embodiments of the present disclosure may include some, all, or none of the above advantages. One or more other technical advantages may be readily apparent to those skilled in the art from the figures, descriptions, and claims included herein. Moreover, while specific advantages have been enumerated above, various embodiments may include all, some, or none of the enumerated advantages.

BRIEF DESCRIPTION OF THE DRAWINGS

Some embodiments of the disclosure are described herein with reference to the accompanying figures. The description, together with the figures, makes apparent to a person having ordinary skill in the art how some embodiments may be practiced. The figures are for the purpose of illustrative description and no attempt is made to show structural details of an embodiment in more detail than is necessary for a fundamental understanding of the disclosure. For the sake of clarity, some objects depicted in the figures are not to scale. In the Figures.

DETAILED DESCRIPTION OF THE INVENTION

Figure 1A:
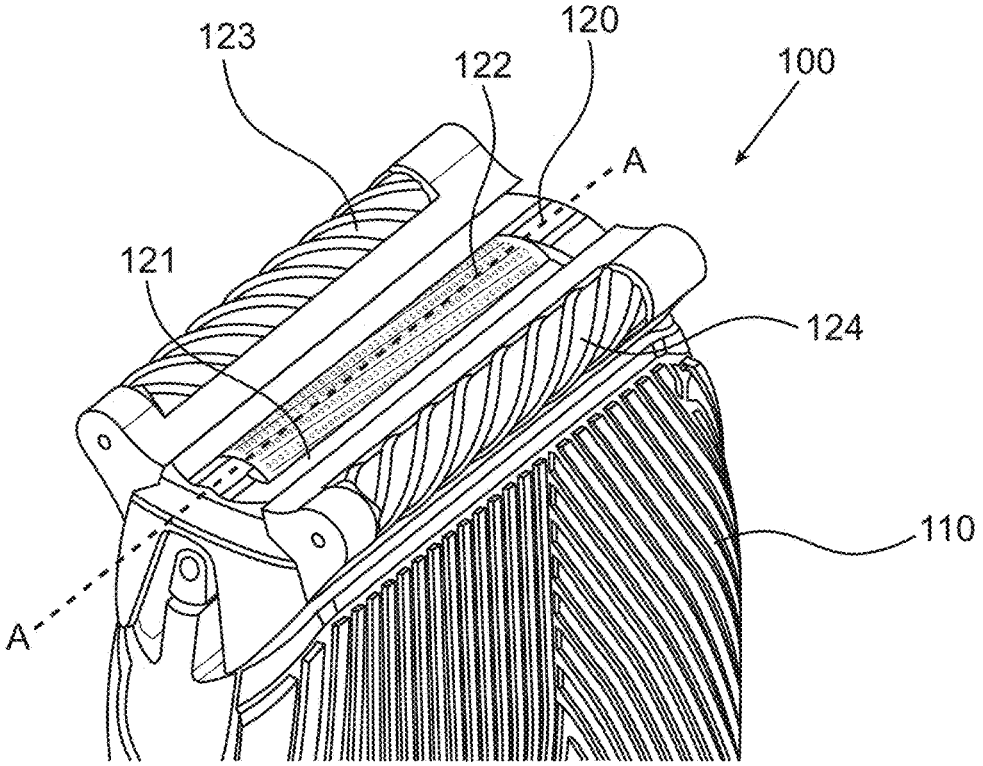
FIGS. 1A-1B—schematic illustrations of a perspective view of a portion of a shaving apparatus in according to some embodiments.

The principles, uses and implementations of the teachings herein may be better understood with reference to the accompanying description and figures. Upon perusal of the description and figures present herein, one skilled in the art will be able to implement the teachings herein without undue effort or experimentation. In the figures, same reference numerals refer to same parts throughout.

In the following description, various aspects of the invention will be described. For the purpose of explanation, specific details are set forth in order to provide a thorough understanding of the invention. However, it will also be apparent to one skilled in the art that the invention may be practiced without specific details being presented herein. Furthermore, well-known features may be omitted or simplified in order not to obscure the invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description.

The embodiments provided herein are directed to components of a head portion of a shaving apparatus. A typical shaving apparatus of the present invention has a handle portion that enables a user to grip the shaving apparatus during shaving operations, a power supply, and a motor to enable the shaving apparatus to function, and possibly a user interface. Parts of the head portion may be detachable from the handle portion so that it may be replaced when it no longer provides the desired cutting performance, typically due to wear on the cutting surfaces or emptying of a dispensing liquid. The head portion typically includes a support structure which supports a rotary cutter and a fixed blade. The head portion may further include an electric motor for rotating the rotary cutter. In alternate embodiments, the electric motor is located in the handle portion. The handle portion is used to manipulate the shaving apparatus during use. The shaving apparatus may comprise a replacement cartridge that includes some or all of the components necessary to cut, trim, shave, or shear the user's facial (or other) hair during use. In yet other embodiments, the support structure, rotary cutter, and fixed blade may be incorporated into the shaving apparatus such that there is no replaceable cartridge.

Figure 1B:
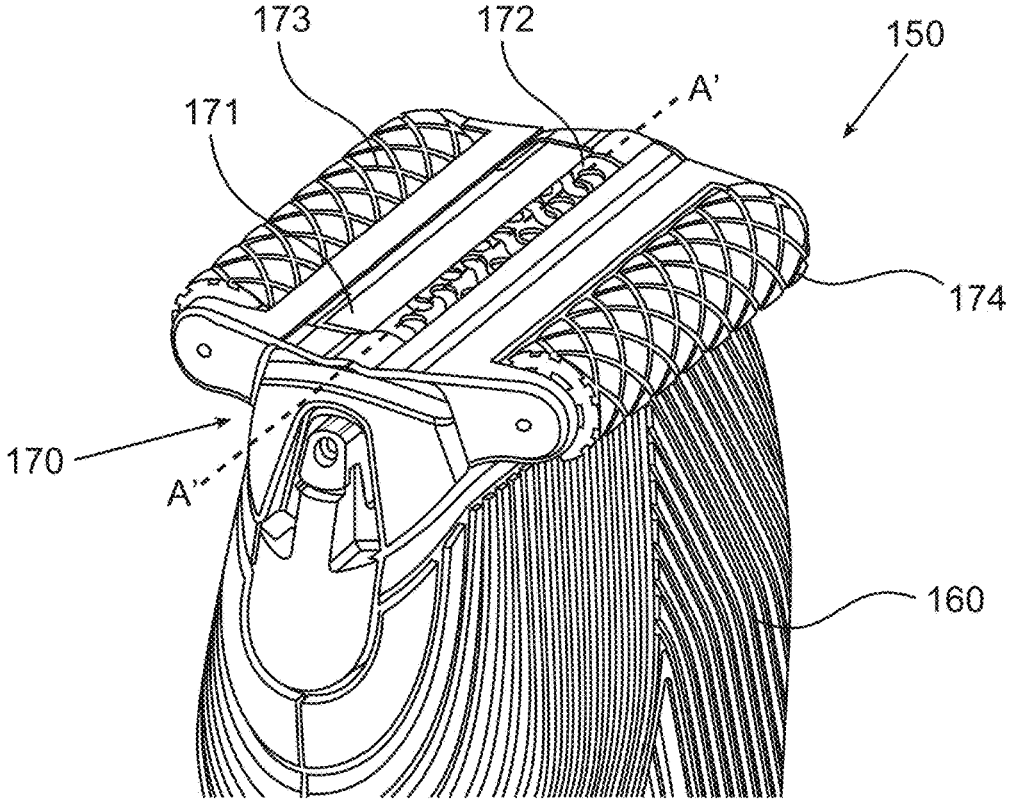

Reference is now made to FIGS. 1A-B, illustrating a shaving apparatus, according to some embodiments. As shown in FIG. 1A, shaving apparatus (100) generally includes a handle portion (110) and a head portion (120). The handle portion (110) is the part of the shaving apparatus that is configured to be held/gripped by a user during shaving, and the head portion (120) is the portion that performs the hair cutting operation. The head portion (120) generally includes a fixed blade (shown as blade 121) and a rotary cutter (122), having apertures on the external surface thereof, which are shown in FIG. 1A as a lattice of elongated apertures, the aperture can generally have any desired geometrical shape. In some embodiments, the apertures lattice is a screen. As detailed below, the apertures can function as hair bristles cutting edges. The rotary cutter is elongated along an axis (shown as axis A-A). The head portion further includes a first roller (123) and a second roller (124). The rollers shown in FIG. 1A have a cylindrical or tubular shape having an outer, external surface that can include ridges or protrusions, as further detailed below. The rollers are configured to be in contact with the skin of the subject utilizing the shaving apparatus and form or maintain a desired distance between the cutting elements (rotary cutter and/or fixed blade) and the skin surface. The first and second rollers (rollers 123 and 124) are elongated in a direction that is parallel to the axis A-A with the first and second rollers 123, 124 being located on opposite sides of the axis A-A, i.e. on different sides of the rotary cutter. Each of the rollers is able to rotate about an axis that is parallel to the axis A-A. Thus, when the rollers 123, 124 contact a user's skin during shaving, the rollers 123, 124 will roll as the shaving apparatus 100 is moved along the skin. However, the rollers 123, 124 need not be configured to roll or rotate in all embodiments and they may be static but merely glide along the user's skin during use while still achieving the function of maintaining a space between the cutting interface (i.e., the location at which a user's hairs are sheared between the rotary cutter 122 and the fixed blade 121) and the skin. In some embodiments, as shown in FIG. 1A, the shaving head can have one fixed elongated blade, placed at an angle relative to the outer surface of the rotary cutter and is located in a direction that is parallel to the axis A-A and located on one of the sides of Axis A-A.

Reference is now made to FIG. 1B which illustrates a similar shaving apparatus as shown in FIG. 1A, with some structural modifications. As shown in FIG. 1B, shaving apparatus (150) includes a handle portion (160) and a head portion (170). The head portion (170) generally includes a fixed blade (shown as blade 171) and a rotary cutter (172), having apertures on the external surface thereof, which are shown in FIG. 1B as a lattice of apertures/holes. In some embodiments, the apertures lattice is a screen. As detailed below, the apertures can function as hair bristles cutting edges. The rotary cutter is elongated along an axis (shown as axis A'-A'). The head portion further includes a first roller (173) and a second roller (174). The rollers shown in FIG. 1B have a cylindrical or tubular shape having an outer, external surface that can include hatched lines, forming a net structure on the face of the rollers. The rollers are configured to be in contact with the skin of the subject utilizing the shaving apparatus and form or maintain a desired distance between the cutting elements (rotary cutter and/or fixed blade) and the skin surface. The first and second rollers (rollers 173 and 174) are elongated in a direction that is parallel to the axis A'-A' with the first and second rollers being located on opposite sides of the axis A'-A', i.e. on different opposing sides of the rotary cutter. Each of the rollers is able to rotate about an axis that is parallel to the axis A'-A'. Thus, when the rollers 173, 174 contact a user's skin during shaving, the rollers will roll as the shaving apparatus 150 is moved along the skin. However, the rollers need not be configured to roll or rotate in all embodiments and they may be static and merely glide along the user's skin during use while still achieving the function of maintaining a space between the cutting interface (i.e., the location at which a user's hairs are sheared between the rotary cutter 172 and the fixed blade 171) and the skin. In some embodiments, as shown in FIG. 1B, the shaving head can have one fixed elongated blade, placed at an angle relative to the outer surface of the rotary cutter and is located in a direction that is parallel to the axis A-A and located on one of the sides of Axis A-A.

Figure 2:
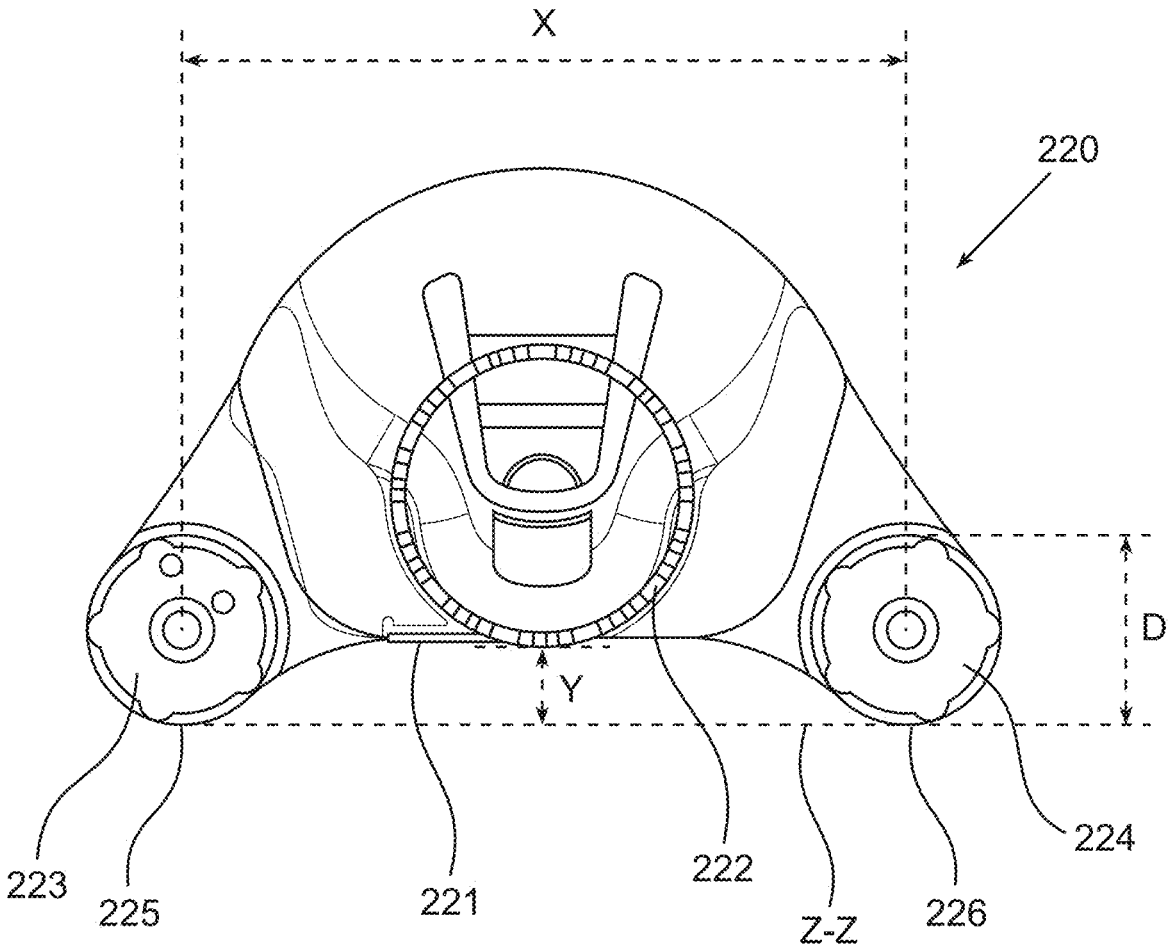
FIG. 2—a schematic side view of a head portion of a shaving apparatus, according to some embodiments.

Reference is now made to FIG. 2, which illustrates a cross section frontal view of a head portion of a shaving apparatus, according to some embodiments. The head portion shown in FIG. 2 is generally similar to the head portions illustrated in FIGS. 1A-B. As shown in FIG. 2, the head portion (220) includes a rotary cutter (222) and a fixed blade (221). Further shown are rollers 223 and 224. In the exemplified embodiment shown in FIG. 2, the first and second rollers (223, 224) have an identical diameter D. The diameter D may be in a range of 4 mm-10 mm in some embodiments. Furthermore, the first roller (223) has a first apex (225) and the second roller (224) has a second apex (226). The first and second apexes (225, 226, respectively) are the portions of the first and second rollers (223, 224) that are located furthest from the fixed blade (221) and rotary cutter (222) in a direction perpendicular to the elongated axis (such as axis A-A in FIG. 1A). The first and second apexes (225, 226) lie in a common plane Z-Z. The plane Z-Z is spaced a distance Y from the outer surface of rotary cutter (222) and/or the fixed blade plain. The distance Y may be between 0.5 mm and 3 mm, in some exemplary embodiments. Thus, when the first and second rollers 223, 224 are just touching a user's skin without applying any pressure to the skin, the rotary cutter 222 and the fixed blade 221 are spaced the distance Y from the skin. Further shown is distance X, which is the distance between the rollers, more particularly, between the center of the rollers.

Figure 3A:
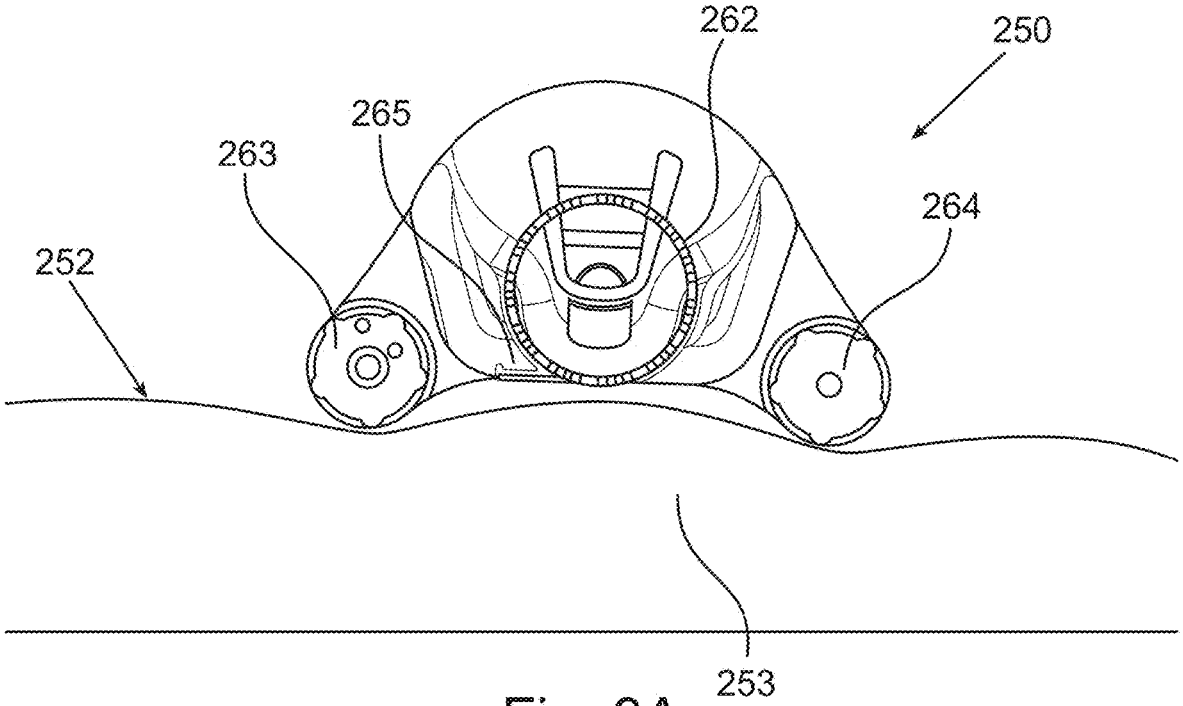
FIGS. 3A-3B illustrate the head portion of the shaving apparatus being pressed against a user's skin surface, according to some embodiments.
Figure 3B:
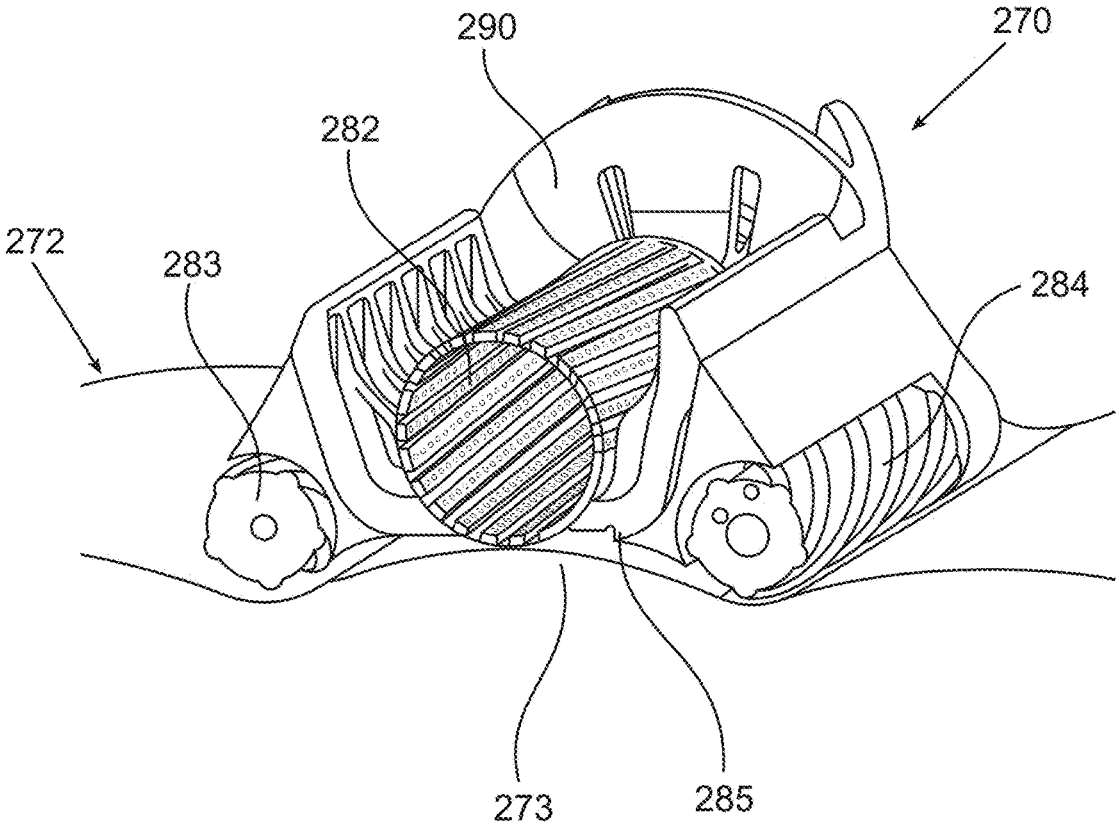

Reference is now made to FIGS. 3A and 3B which illustrate views of a head portion of a shaving apparatus in contact with a user's skin, according to some embodiments. As can be seen in FIG. 3A, illustrating a frontal side view of head portion (250) of a shaving apparatus, when the head portion (250) is brought into engagement with the skin (252), the first and second rollers (263, 264) contact the skin while maintaining the fixed blade (265) and the rotary cutter (262) at a distance/space above the skin. As pressure is applied onto the user's skin using the first and second rollers, the fixed blade (265) and rotary cutter (262) come closer to the portion of the skin that is located between the first and second rollers (skin portion 253). Thus, hairs that are growing on the portion of the skin that is located between the first and second rollers can then be cut by the shaving apparatus, as detailed above. Reference is now made to FIG. 3B, which illustrates a perspective view of a head portion (270) of a shaving apparatus, having the external top cover (which is opposite the side of the cutting region) of the head portion removed (for display purposes). As shown in FIG. 3B, when the head portion (270) is brought into engagement with the skin (272), the first and second rollers (283, 284) contact the skin while maintaining the fixed blade (285) and the rotary cutter (282) at a distance/space above the skin. As pressure is applied onto the user's skin using the first and second rollers, the fixed blade (285) and rotary cutter (282) come closer to the portion of the skin that is located between the first and second rollers (skin portion 273). Thus, hairs that are growing on the portion of the skin that is located between the first and second rollers can then be cut by the shaving apparatus, as detailed above. As shown in FIG. 3B, the rotary cutter is in the form of a hollow cylinder having apertures (organized in a net or lattice structure) on the external circumferences, the apertures function as cutting edges, as detailed above. As exemplified in the illustration shown in FIG. 3B, the rotary cutter is situated in a suitable casing (290), allowing it's rotation, as detailed herein. In some embodiments, the suitable casing has a shape concurrent to the shape of the rotary cutter, to allow its accommodation and rotation. The casing may further include one or more hinges, axes, and the like, allowing operation (rotation) of the rotary cutter. As further shown in FIG. 3B, the rollers have protrusions or ridges on their external surface, which can aid in function of the rollers (including, enhancing skin contact, providing massage to the skin, and the like, as further detailed below).

According to some embodiments, the rollers enable shaving to be achieved without any need to push or rub the rotary cutter and/or fixed blade 121 against the skin. Rather, the first and second rollers can roll along the skin while maintaining the rotary cutter and the fixed blade 121 above the skin (for example at a distance Y), so that the rotary cutter and the fixed blade can function, preferably in synergy, to cut the hair. In other words, the rotary cutter and the fixed blade act as a "low flying scissors" or "hovering scissors", to cut the hair as they glide above the skin, preferably without touching the skin.

Thus, according to some embodiments, using the shaving apparatus disclosed herein, the hair can be cut smooth and close to perpendicular. This may aid to avoid the hair growing back into the skin. The lack of direct forcible contact between the rotary cutter and the user's skin can prevent irritations, particularly for users with sensitive skin. Furthermore, it avoids heat generated by the rotary cutter and the fixed blade from being transmitted to the skin and prevents friction from rubbing, that causes skin irritation and razor burn. The elements that are actually doing the cutting action (i.e., the fixed blade and the rotary cutter) remain located at the skin level, preferably with minimal or no contact, with only a light or no pressure required to perform the desired cutting.

Figure 4A:
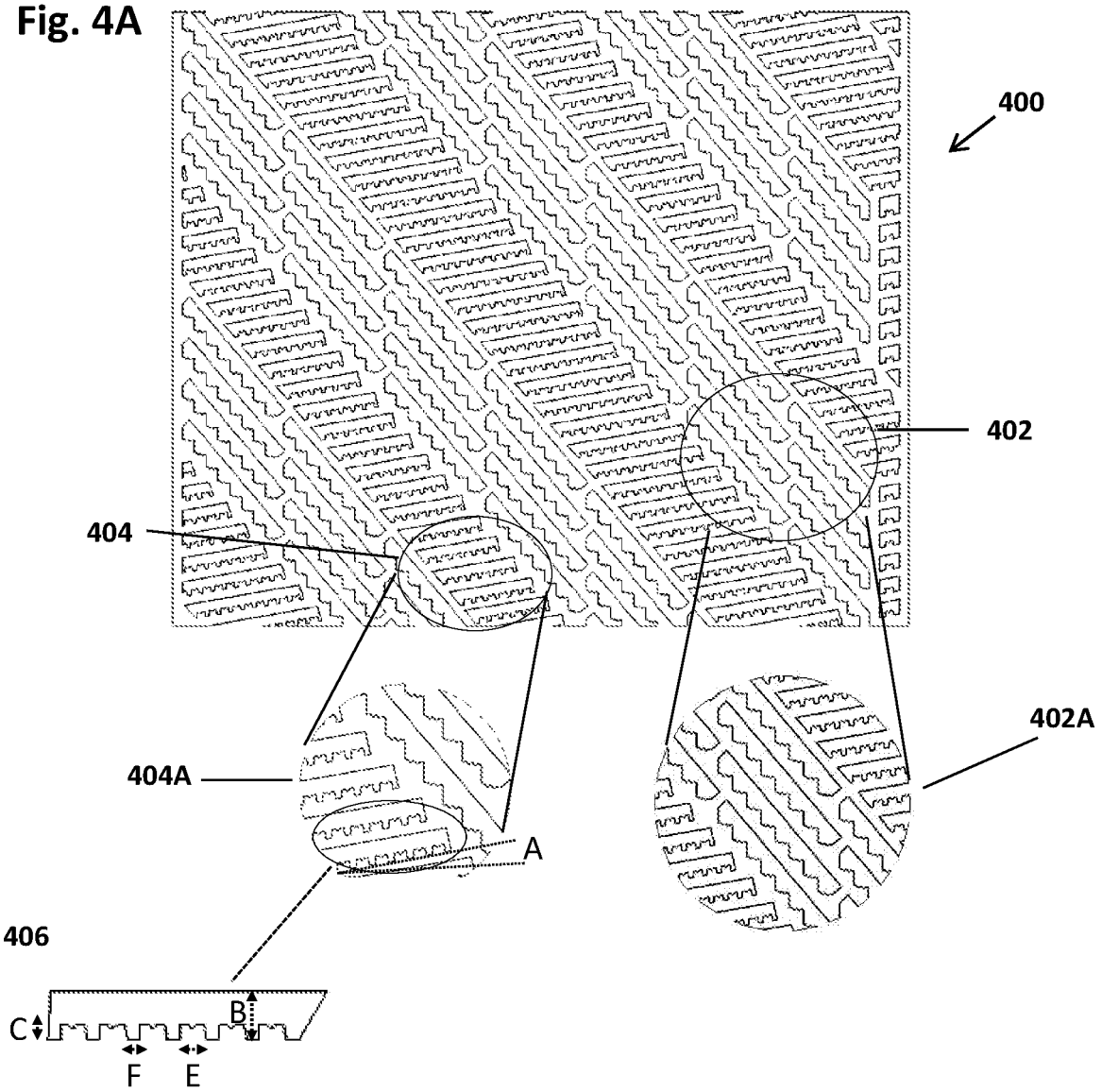
FIGS. 4A-4B illustrate close up perspective views of portions of a screen of a rotary cutter of a shaving apparatus, according to some embodiments.
Figure 4B:
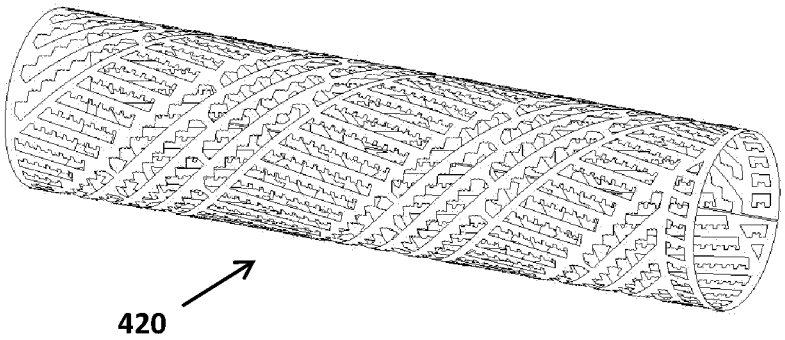

Reference is now made to FIGS. 4A-B, which illustrate portion of an external surface of a rotary cutter and the apertures thereof, according to some embodiments. As shown in FIG. 4A, a flat portion (400) of the external surface (screen) of a rotary cutter is presented. As shown, the rotary cutter screen (drum) includes a series of elongated, generally rectangular holes/perforations/apertures, the runs along horizontal and longitudinal lines. Further shown in FIG. 4A, is enlargement (zoom-in view, marked with circles) of areas/regions 402 (enlargement view 402A) and 404 (enlargement view 404A), of screen (400). As shown in FIG. 4A, the holes may have a plurality of "fingers" which extend from one side of the holes. An enlargement of a region 402 (marked with circle) illustrates in view 406, the arrangement of the "fingers". In some embodiments, they are arranged at an angle A with respect to the axis of rotation of the rotary cutter. The fingers have a height C, a width F and spaced apart by a distance E. The distance between the distal ends of the fingers and the opposing side of the slot is defined by a distance B. In some embodiments, the angel A may range from 0 to 25 degrees. In some exemplary embodiments, the distance B may equal to 2 to 6 times a nominal hair diameter. In some exemplary embodiments, the dimension C, F and E are 2 to 4 times a nominal hair diameter. In some embodiments, such arrangements of holes provides such features as, minimize the perforated hole in the screen (drum) to avoid skin entering below the fixed blade; maximize the hair cutting events per rotary cutter rotation (i.e. providing more effective holes per area); maximize the effective cut line per rotation, where the effective cut line is the portion of the hole wall that will cross the blade at a desired angle (for example, less than 25 degrees); and introduce "fingers" structure to aid in manipulating hard to reach hair. Reference is now made to FIG. 4B, which shows a perspective view of a rotary cutter screen, 420, according to some embodiments. The rotary cutter (420) shown in FIG. 4B acquires a tubular shape, by rolling/forming the screen presented in FIG. 4A, to assume a tubular shape of a rotary cuter.

In some embodiments, a rotary cutter is also referred to herein as a swivel blade.

Figure 5:
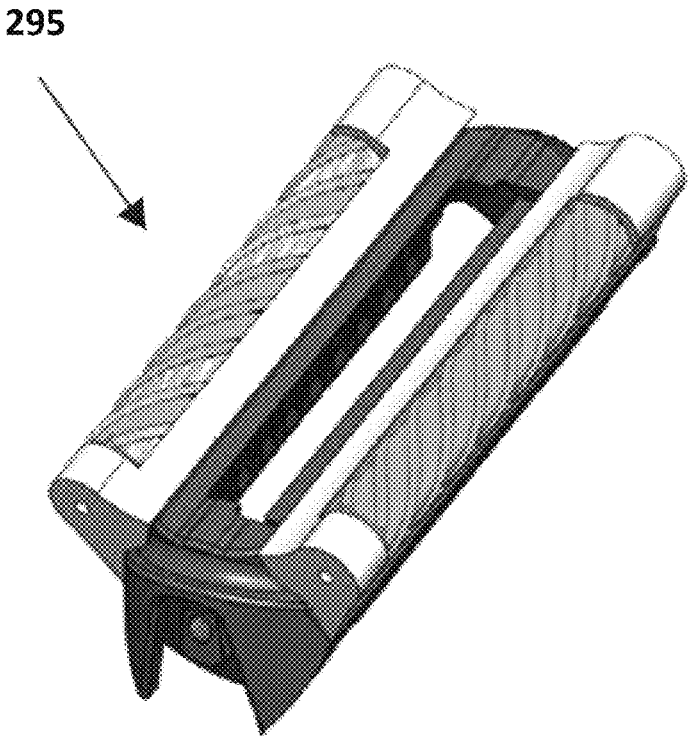
FIG. 5 illustrates disposable components (cartridges) of a shaving apparatus, according to some embodiments.

Referring to FIG. 5, in some embodiments the shaving apparatus or at least the head portion thereof, may include replaceable cartridge, such as, cartridge 295 that include rollers as disclosed herein, and may also optionally include a fixed blade. In such embodiments, the rotary cutter may be secured to the shaving apparatus and the replaceable cartridge may be detachably coupled to the shaving apparatus. One advantage of this setting is that in some embodiments, the rollers may be configured to dispense a suitable product or substance onto the user's skin during use. In such embodiments, the rollers may be optionally hollow or have an empty cavity, and the substance may be stored or located within the hollow cavity of the rollers. According to some embodiments, the substance may include, for example, but not limited to: a cream, an ointment, a solution, a liquid, a gel, a moisturizing cream, a conditioning cream, a treating cream or ointment, a shaving cream, a medicinal cream or ointment, a lubricating substance, a skin calming substance, PEG, or ingrowing hair treatment such as Salicylic acid, Aloe Vera, or the like, or any combination thereof. Each possibility is a separate embodiment. The substance may be dispensed onto the user's skin by the rollers, by manual dispensing (manually controlled by the user) and/or automatically, during the shaving process. In some embodiments, the substance may be a cream that can be a liquid, gel, or cream that is used in the shaving process or that is used to treat conditions on the skin.

In some embodiments, different replacement cartridges may have rollers that dispense different products/substances. Thus, depending on the type of product that the user desires to have dispensed, the user can swap out the replacement cartridge to select the one that dispenses the desired product during use. In this way, the shaving apparatus can be tailored for an individual consumer. In further embodiments, the replacement cartridges may have different types of rollers, that may further increase versatility of use. For example, the rollers may differ in the material from which they are made and/or in their physical properties, such as, flexibility, rigidity, elasticity, and the like. In some embodiments, the rollers may have different external/outer surfaces that may differ in their texture and/or structure. For example, the outer surface may include circular ridges, spiral ridges, hatched ridges, spikes, protrusions, and the like, or any combination thereof. In some embodiments, the outer surface of the rollers may include brushes. In some embodiments, the outer surface of the rollers may aid in providing a massaging action to the skin, may aid is stretching the skin for the shaving, and the like. Each possibility is a separate embodiment.

Figure 6A:
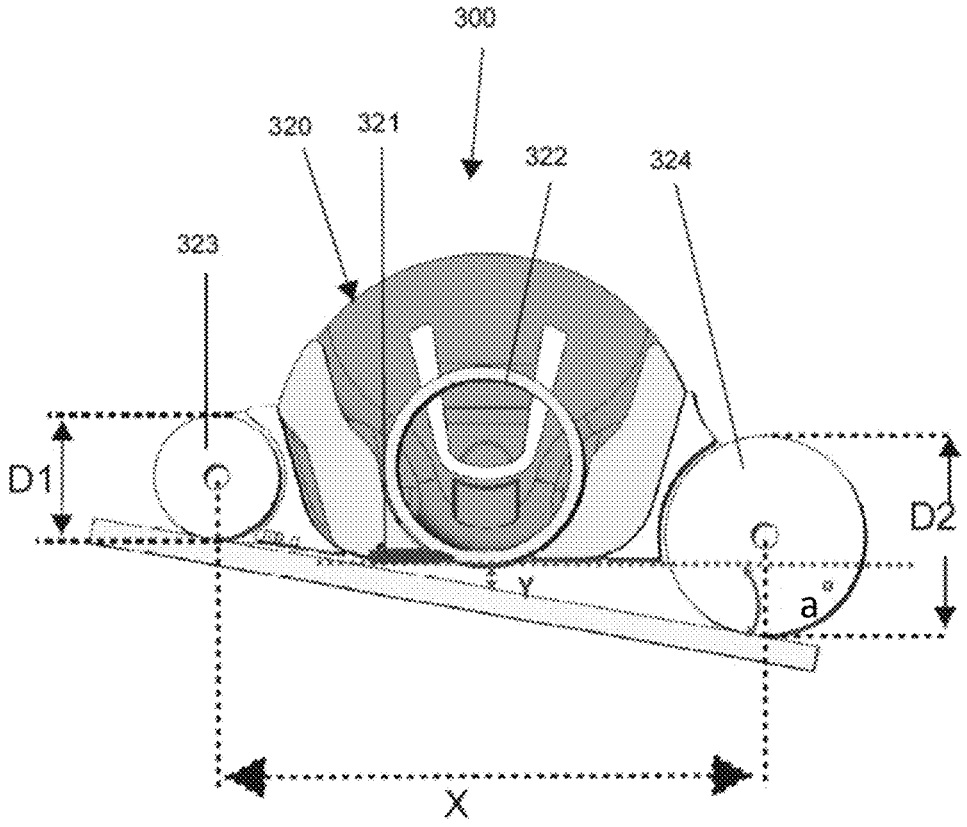
FIG. 6A is a schematic illustration of a head portion of a shaving apparatus in accordance with some embodiments.
Figure 6B:
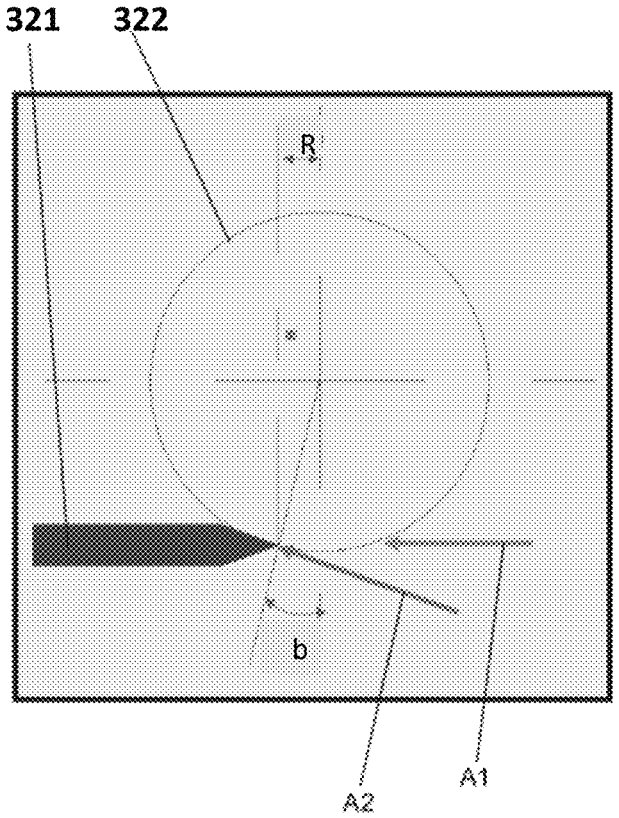
FIG. 6B is a schematic close up view of head portion of a shaving apparatus, according to some embodiments.

Reference is now made to FIGS. 6A-B, showing another embodiment of a shaving apparatus. As shown in FIG. 6A, shaving apparatus (300) generally includes a head portion (320) having a fixed blade (321), a rotary cutter (322), a first roller (323), and a second roller (324) similar to that which was described above herein. The rollers shown in FIG. 6A have different diameters, i.e., diameters D1, D2 of the first and second rollers, respectively. Specifically, in this embodiment the diameter D1 of the first roller 323 is different than the diameter D2 of the second roller 324. Due to the differences in the diameters D1, D2 of the first and second rollers, as the shaving apparatus (and in particular, the head portion which is engaging the skin), is moved across a skin surface, the junction of the cutting edges of the rotary cuter (322) and the fixed blade (321) is oriented at an acute angle (angle "a") relative to the skin surface. In some example embodiments, the angle a may be a 12°-14° angle, although the angle could be between 5° and 30°, and more specifically between 10° and 20°, in other embodiments.

According to some embodiments, aside from adjusting the diameters D1, D2 of the rollers, the angle ("a") noted above can also be changed by modifying the location at which the first and second rollers 323, 324 are attached to the head portion 320. Specifically, the first and second rollers 323, 324 could have the same diameter but one could be mounted closer to the working surface and the other mounted further from the working surface. In other embodiments, combinations of modifying the diameters of the first and second rollers 323, 324 and modifying the mounting location of the first and second rollers 323, 324 can be used to achieve the desired shaving angle. In some embodiments, the distance (X) between the rollers may be adjusted, for example, by use of springs, or the like. In some exemplary embodiments, the diameter of the first roller may be about 5 mm, the diameter of the second roller may be about 8 mm, distance Y may be about 1 mm, distance X may be about 21.9 mm, and angle a may be about 12°.

In the schematic drawing shown in FIG. 6B, the arrow A1 illustrates the direction that the skin approaches the fixed blade (321) during use. Utilizing the different diameters of the first and second rollers (323, 324, or otherwise modifying the location of the apex or center of the first and second rollers), the skin can be fed towards the junction of the fixed blade (321) and the rotary cutter (322) at an angle (b), as shown with the arrow A2. This setting may achieve an improvement in the closeness of the shave while still keeping the fixed blade (321) gliding above (i.e., spaced apart) from the skin during use, as described above. Further shown in distance R, between the apex (or center) of the rotary blade (322) and the junction point with the fixed blade (321).

According to some embodiments, the shaving apparatus can further include a power source and motor that are disposed within the handle portion (for example, handle portion 110 in FIG. 1A or handle portion 160 in FIG. 1). In some embodiments, the power source and/or motor may be located in the head portion of the shaving apparatus.

In some embodiments, when the shaving apparatus is powered on, power is transmitted from the power source to the motor to rotate the motor, which in turn causes the rotary cutter to rotate. In some embodiments, the rotary cutter includes a plurality of cutting edges (for example, in the form of apertures, or openings in the external, outer surface (screen) of the rotary cutter). As the rotary cutter rotates and the shaving apparatus is moved across a user's skin surface (such as on the face or other skin region), the user's hairs are cut due to the interaction or engagement between the cutting edges of the rotary cutter and the fixed blade. Specifically, the user's hairs can be sheared or cut between the cutting edges of the rotary cutter and the fixed blade due to the rotation of the rotary cutter.

In some embodiments, the rollers can have a cylindrical or tubular shape having an outer, external surface that can include ridges or protrusions, as further detailed below. In some embodiments, the outer surface of the rollers may be smooth or can include any types of grooves, or protrusions that can aid in their function.

In some embodiments, the rollers can be made of any suitable material, including, but not limited to: plastic, rubber, metal, and the like.

In some embodiments, the rollers may be identical or similar in size (diameter), shape, form, texture and/or composition (i.e., the material they are made of). In some embodiments, the rollers may differ from each other in their size (diameter), shape, form, texture and/or composition.

In some embodiments, the rollers are configured to be in contact with the skin of the subject utilizing the shaving apparatus and form or maintain a desired distance between the cutting elements (rotary cutter and/or fixed blade) and the skin surface.

In some embodiments, the rollers are elongated in a direction that is parallel to the axis along which the rotary blade is elongated, with the rollers being located on opposite sides of this axis A-A, i.e. on different, opposing sides of the rotary cutter.

In some embodiments, each of the rollers may be able to rotate about an axis that is parallel to the elongated axis. Thus, when the rollers contact a user's skin during shaving, the rollers can roll as the shaving apparatus is moved along the skin. In some embodiments, the rollers need not be configured to roll or rotate and they may be static and merely glide along the user's skin during use while still achieving the function of maintaining a space between the cutting interface (i.e., the location at which a user's hairs are sheared between the rotary cutter and the fixed blade) and the skin surface.

In some embodiments, the diameter of the rollers (in some embodiments referred to as diameter D) may be in a range of about 2 mm-12 mm, or any subranges thereof. In some embodiments, the diameter may be in the range of about 4 mm-10 mm. In some embodiments, the diameter may be in the range of about 6 mm-8 mm. In some embodiments, each of the rollers may have a different diameter. In such embodiments, one roller may have a diameter in the range of about 2-7 mm and the diameter of the second roller may be in the range of about 8-12 mm. In some embodiments, the diameter of a first roller may be in the range of about 4-6 mm and the diameter of the second roller may be in the range of about 7-9 mm. In some exemplary embodiments, the diameter (D1) of the first roller may be approximately 5 mm and the diameter (D2) of the second roller may be approximately 8 mm.

In some embodiments, the distance from the outer surface of the rotary cutter and the common plain in which the apexes of the rollers lay in (also referred to herein as distance Y), may be, for example, between about 0.25 mm and 7 mm, or any subranges thereof. Each possibility is a separate embodiment. In some embodiments, the distance Y is in the range of about 0.3 to 6 mm. In some embodiments, the distance Y is in the range of about 0.5 to 5 mm. In some embodiments, the distance Y is in the range of about 0.6 to about 4 mm. In some embodiments, the distance Y may be in the range of about 0.8 to about 3 mm. In some embodiments, to achieve close, smooth shaving, the distance Y may be between about 0.25 m to about 2 mm, and any subranges thereof. In some embodiments, when using the shaving apparatus for trimming of hair, or hair design/styling, the distance Y may be between, for example, 2-20 mm, or any subranges thereof. According to some embodiments, the distance Y may be adjusted or determined based on the length of the hair. According to some embodiments, the distance Y may be adjusted or determined based on the purpose of the hair removal, for example if for close shaving (i.e. cutting the hair to a minimum length), if for shaving or trimming or styling (i.e., cutting the hair to a desired length). In some embodiments, the distance Y is substantially similar or equal to the distance between the skin surface and the cutting elements (i.e. rolling cutter and/or fixed blade(s)). In some embodiments, the distance between the rotary cutting element and/or the fixed blade and the skin region may be in the range of about 0.5 mm to 3 mm, when not forcing these elements against the skin region.

According to some embodiments, the distance between the centers of the rollers may be fixed or adjusted, for example, by use of springs, allowing changing said distance.

In some embodiments, the shaving head can have one on more fixed elongated blades. The fixed blade(s) can be placed at an angle relative to the outer surface of the rotary cutter and may be located in a direction that is parallel to the rotary cutter, in close proximity thereto. In some embodiments, the fixed blade(s) are flexible. In some embodiments, the fixed blade(s) are disposable. In some embodiments, the fixed blade(s) are replaceable.

In some embodiments, the junction of the cutting edges of the rotary cuter and the fixed blade may be oriented at an acute angle (also referred to herein as angle "a"), relative to the skin surface, in particular if rollers having different diameter are used, or if location at which the first and second rollers are attached to the head portion are adjusted. In some exemplary embodiments, the angle a may be a 12°-14° angle. In some embodiments, the angle may be between 5° and 30°, or any subranges thereof. In some embodiments, the angle may be between 10° and 20°.

According to some embodiments, there is provided a shaving apparatus comprising: a handle portion and a head portion, said head portion comprises:

- a rotary cutting element comprising a cylindrical screen having a plurality of cutting edge openings on the outer surface thereof, the screen being rotatable about a rotational axis;
- one or more fixed blades located in close proximity to the outer surface of the rotary cutting element; and
- at least two roller elements configured to be in contact with a skin surface of a subject and to further control or maintain a distance between the rotary cutting element and/or the fixed blade and the skin of the subject, such that the rotary cutting element and/or the fixed blades are capable of cutting hair bristles from the skin, while maintaining essentially minimal contact with the skin surface.

According to some embodiments, there is provided a shaving apparatus comprising: a handle portion and a head portion, said head portion comprises:

a rotary cutting element comprising a cylindrical screen having a plurality of cutting edge openings on the outer surface thereof, the screen being rotatable about a rotational axis;

one or more fixed blades located in close proximity to the outer surface of the rotary cutting element; and one or more roller elements configured to be in contact with a skin surface of a subject and to further control or maintain a distance between the rotary cutting element and/or the fixed blade and the skin of the subject, such that the rotary cutting element and/or the fixed blades are capable of cutting hair bristles from the skin, while maintaining essentially minimal contact with the skin surface.

According to some embodiments, there is provided a head portion of a shaving apparatus comprising:

a rotary cutting element comprising a cylindrical screen having a plurality of cutting edge openings on the outer surface thereof, the screen being rotatable about a rotational axis;

one or more fixed blades located in close proximity to the outer surface of the rotary cutting element; and one or more roller elements configured to be in contact with a skin surface of a subject and to further control or maintain a distance between the rotary cutting element and/or the fixed blade and the skin of the subject, such that the rotary cutting element and/or the fixed blades are capable of cutting hair bristles from the skin, while maintaining essentially minimal contact with the skin surface.

According to some embodiments, there is provided a head portion of a shaving apparatus comprising:

a rotary cutting element comprising a cylindrical screen having a plurality of cutting edge openings on the outer surface thereof, the screen being rotatable about a rotational axis;

one or more fixed blades located in close proximity to the outer surface of the rotary cutting element; and at least two roller elements configured to be in contact with a skin surface of a subject and to further control or maintain a distance between the rotary cutting element and/or the fixed blade and the skin of the subject, such that the rotary cutting element and/or the fixed blades are capable of cutting hair bristles from the skin, while maintaining essentially minimal contact with the skin surface.

According to some embodiments, there is provided a method of shaving a skin surface, the method comprising the steps of:

Pressing a head portion of a shaving apparatus, said head portion comprises:

a rotary cutting element comprising a cylindrical screen having a plurality of cutting edge openings on the outer surface thereof, the screen being rotatable about a rotational axis;

one or more fixed blades located in close proximity to the outer surface of the rotary cutting element; and one or more roller elements;

such that the roller elements are configured to be in contact with the skin surface of the subject and allow controlling or maintaining a distance between the rotary cutting element and/or the fixed blade and the skin of the subject, such that the rotary cutting element and/or the fixed blades are capable of cutting hair bristles from the skin, while maintaining essentially minimal contact with the skin surface.

According to some embodiments, there is provided a method of shaving a skin surface, the method includes:

Pressing a head portion of a shaving apparatus, said head portion comprises:

a rotary cutting element comprising a cylindrical screen having a plurality of cutting edge openings on the outer surface thereof, the screen being rotatable about a rotational axis;

one or more fixed blades located in close proximity to the outer surface of the rotary cutting element; and at least two roller elements;

such that the roller elements are configured to be in contact with the skin surface of the subject and allow controlling or maintaining a distance between the rotary cutting element and/or the fixed blade and the skin of the subject, such that the rotary cutting element and/or the fixed blades are capable of cutting hair bristles from the skin, while maintaining essentially minimal contact with the skin surface.

In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

In the description and claims of the application, the words "include" and "have", and forms thereof, are not limited to members in a list with which the words may be associated.

As used herein, the term "about" may be used to specify a value of a quantity or parameter (e.g. the length of an element) to within a continuous range of values in the neighborhood of (and including) a given (stated) value. According to some embodiments, "about" may specify the value of a parameter to be between 80% and 120% of the given value. For example, the statement "the length of the element is equal to about 1 m" is equivalent to the statement "the length of the element is between 0.8 m and 1.2 m". According to some embodiments, "about" may specify the value of a parameter to be between 90% and 110% of the given value. According to some embodiments, "about" may specify the value of a parameter to be between 95% and 105% of the given value.

Unless otherwise defined, all technical and scientific terms used herein have the same meaning as commonly understood by one of ordinary skill in the art to which this disclosure pertains. In case of conflict, the patent specification, including definitions, governs. As used herein, the indefinite articles "a" and "an" mean "at least one" or "one or more" unless the context clearly dictates otherwise.

It is appreciated that certain features of the disclosure, which are, for clarity, described in the context of separate embodiments, may also be provided in combination in a single embodiment. Conversely, various features of the disclosure, which are, for brevity, described in the context of a single embodiment, may also be provided separately or in any suitable sub-combination or as suitable in any other described embodiment of the disclosure. No feature described in the context of an embodiment is to be considered an essential feature of that embodiment, unless explicitly specified as such.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

The invention claimed is:

1. A shaving apparatus comprising: a handle portion and a head portion, said head portion comprises:

a rotary cutting element comprising a cylindrical screen having a plurality of cutting edge openings on the outer surface thereof, the screen being rotatable about a rotational axis;

one or more fixed blades located in close proximity to the outer surface of the rotary cutting element; and one or more roller elements configured to be in contact with a skin surface of a subject and to further control or maintain a distance between the rotary cutting element and the skin of the subject or a distance between the fixed blade and the skin of the subject, such that the rotary cutting element and/or the fixed blades are capable of cutting hair bristles from the skin, while maintaining essentially minimal contact with the skin surface.

2. The shaving apparatus according to claim 1, wherein the roller elements are substantially tubular or cylindrical.

3. The shaving apparatus according to claim 1, wherein one or more of the roller elements comprises an outer surface with ridges protruding therefrom.

4. The shaving apparatus according to claim 1, wherein the roller elements are placed in a direction that is parallel to the elongated rotational axis of the rotary cutting element.

5. The shaving apparatus according to claim 1, wherein a first roller element and a second roller element are located on opposite sides of the rotational axis of the rotary cutting element.

6. The shaving apparatus of according to claim 1, wherein the one or more roller elements have a similar or different diameter.

7. The shaving apparatus according to claim 1, wherein the one or more roller elements are fixed or movable along a horizontal axis.

8. The shaving apparatus according to claim 1, wherein the distance between the outer surface of the rotary cutting element and the common plain in which the apexes of the one or more roller elements lay in or the distance between the fixed blade and the common plain in which the apexes of the one or more roller elements lay in, is in the range of about 0.5 mm to 3 mm.

9. The shaving apparatus according to claim 1, wherein the diameter of the one or more roller elements is in the range of about 4 mm to about 10 mm.

10. The shaving apparatus according to claim 1, wherein the one or more roller elements comprise a cavity and are further configured to dispense a substance.

11. The shaving apparatus according to claim 1, wherein the rotary cutting element and the fixed blade allow cutting of the hair by the action of flying scissors and/or wherein the shaving apparatus is configured to allow close shaving of the skin of the subject without generating heat at the skin surface and/or without applying pressure on the skin.

12. The shaving apparatus according to claim 1, wherein the cutting edge openings comprise holes having various geometrical shapes.

13. The shaving apparatus according to claim 1, further comprising a motor and a power source.

14. The shaving apparatus of according to claim 1, wherein the head portion is configured to be reversibly mounted on the handle portion and/or wherein the head portion is disposable.

15. A head portion of a shaving apparatus, the head portion comprising:

a rotary cutting element comprising a cylindrical screen having a plurality of cutting edge openings on the outer surface thereof, the screen being rotatable about a rotational axis;

one or more fixed blades located in close proximity to the outer surface of the rotary cutting element; and one or more roller elements configured to be in contact with a skin surface of a subject and to further control or maintain a distance between the rotary cutting element and the skin of the subject or a distance between the fixed blade and the skin of the subject, such that the rotary cutting element and/or the fixed blades are capable of cutting hair bristles from the skin, while maintaining essentially minimal contact with the skin surface.

16. The head portion according to claim 15, wherein the one or more flexible blades and the one or more roller elements are mounted on a replaceable cartridge that is detachably coupled to the head portion.

17. The head portion according to claim 15, wherein the one or more rollers are placed in a direction that is parallel to the elongated rotational axis of the rotary cutting element and/or wherein a first roller element and a second roller element are located on opposite sides of the rotational axis of the rotary cutting element.

18. The head portion according to claim 15, wherein the one or more roller elements have a similar diameter or different diameter and/or wherein the one or more roller elements are fixed or movable along a horizontal axis.

19. The head portion according to claim 15, wherein the one or more roller elements comprise a cavity and are further configured to dispense a substance.

20. A method of shaving a skin surface, the method comprising:

pressing a head portion of a shaving apparatus, said head portion comprises:

a rotary cutting element comprising a cylindrical screen having a plurality of cutting edge openings on the outer surface thereof, the screen being rotatable about a rotational axis;

one or more fixed blades located in close proximity to the outer surface of the rotary cutting element; and one or more roller elements;

such that the one or more roller elements are configured to be in contact with the skin surface of the subject and allow controlling or maintaining a distance between the rotary cutting element and the skin of the subject, or a distance between the fixed blade and the skin of the subject, such that the rotary cutting element and/or the fixed blades are capable of cutting hair bristles from the skin, while maintaining essentially minimal contact with the skin surface.

* * * * *